US008979614B2

(12) United States Patent
Yang et al.

(10) Patent No.: US 8,979,614 B2
(45) Date of Patent: Mar. 17, 2015

(54) DEBURRING MACHINE

(75) Inventors: Ming-Lu Yang, New Taipei (TW); Liang Zhu, Shenzhen (CN); Zhong-Wei Yang, Shenzhen (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 351 days.

(21) Appl. No.: 13/480,713

(22) Filed: May 25, 2012

(65) Prior Publication Data

US 2013/0109283 A1 May 2, 2013

(30) Foreign Application Priority Data

Oct. 31, 2011 (CN) ..... 2011 1 0337339

(51) Int. Cl.
*B24B 9/00* (2006.01)

(52) U.S. Cl.
CPC ..... *B24B 9/005* (2013.01)
USPC ..... 451/65; 451/178; 451/292; 451/332; 451/361; 451/401

(58) Field of Classification Search
CPC ..... B24B 5/025; B24B 5/32; B24B 7/04; B24B 9/00; B24B 9/005; B24B 27/0023; B24B 27/0069; B24B 33/04; B24B 41/005; B24B 47/10; B24B 47/16; B24B 49/00
USPC ..... 451/5, 65, 66, 149, 178, 308, 332, 360, 451/361, 401
See application file for complete search history.

(56) References Cited

U.S. PATENT DOCUMENTS

| | | | | |
|---|---|---|---|---|
| 1,989,517 | A * | 1/1935 | Holmes | 451/247 |
| 4,052,821 | A * | 10/1977 | McCandless et al. | 451/149 |
| 4,651,471 | A * | 3/1987 | Makino et al. | 451/57 |
| 5,065,651 | A * | 11/1991 | Amey | 82/1.11 |
| 5,299,394 | A * | 4/1994 | Surdacki | 451/50 |
| 6,120,358 | A * | 9/2000 | Porter | 451/57 |
| 6,685,542 | B2 * | 2/2004 | Mori et al. | 451/65 |
| 2007/0167114 | A1 * | 7/2007 | Fromel et al. | 451/11 |

FOREIGN PATENT DOCUMENTS

| | | | |
|---|---|---|---|
| CN | 2054393 | U | 3/1990 |
| CN | 102039548 | A | 5/2011 |
| CN | 201979359 | U | 9/2011 |
| TW | 340434 | | 9/1998 |

* cited by examiner

*Primary Examiner* — Timothy V Eley
(74) *Attorney, Agent, or Firm* — Novak Druce Connolly Bove + Quigg LLP

(57) ABSTRACT

A deburring machine for removing burrs from workpieces includes a framework, a deburring mechanism and a transport mechanism. The deburring mechanism mounted on the framework, includes deburring units positioned on the framework. The transport mechanism is positioned on the framework adjacent to the deburring units. The transport mechanism includes a base, multi-station rotating plate and a first driver. The base is positioned on the framework. The multi-station rotating plate is rotatably positioned on the base. The first driver is positioned on the framework and connects with the base. The first driver is capable of driving the multi-station rotating plate to transport the workpieces to the plurality of deburring units, the plurality of deburring units are capable of removing the burrs of the workpieces.

19 Claims, 8 Drawing Sheets

DEBURRING MACHINE

BACKGROUND

1. Technical Field

The present disclosure relates to a deburring machine, and particularly to a deburring machine for removing burrs from workpieces mechanically and in massive quantities.

2. Description of Related Art

Metal workpieces have burrs that have been leftover during a mechanical machining process. Removal of such burrs helps to prevent injury to workers and improves the workpieces appearance. The burrs left in the side walls of holes or grooves of the metal workpieces, especially on some small workpieces, are removed by manual deburring one at a time. However, the whole procedure of manual deburring is both time and labor consuming. In addition, the workpieces are easily damaged during the manual deburring treatment procedure.

Therefore, there is room for improvement within the art.

DETAILED DESCRIPTION

Figure 1:
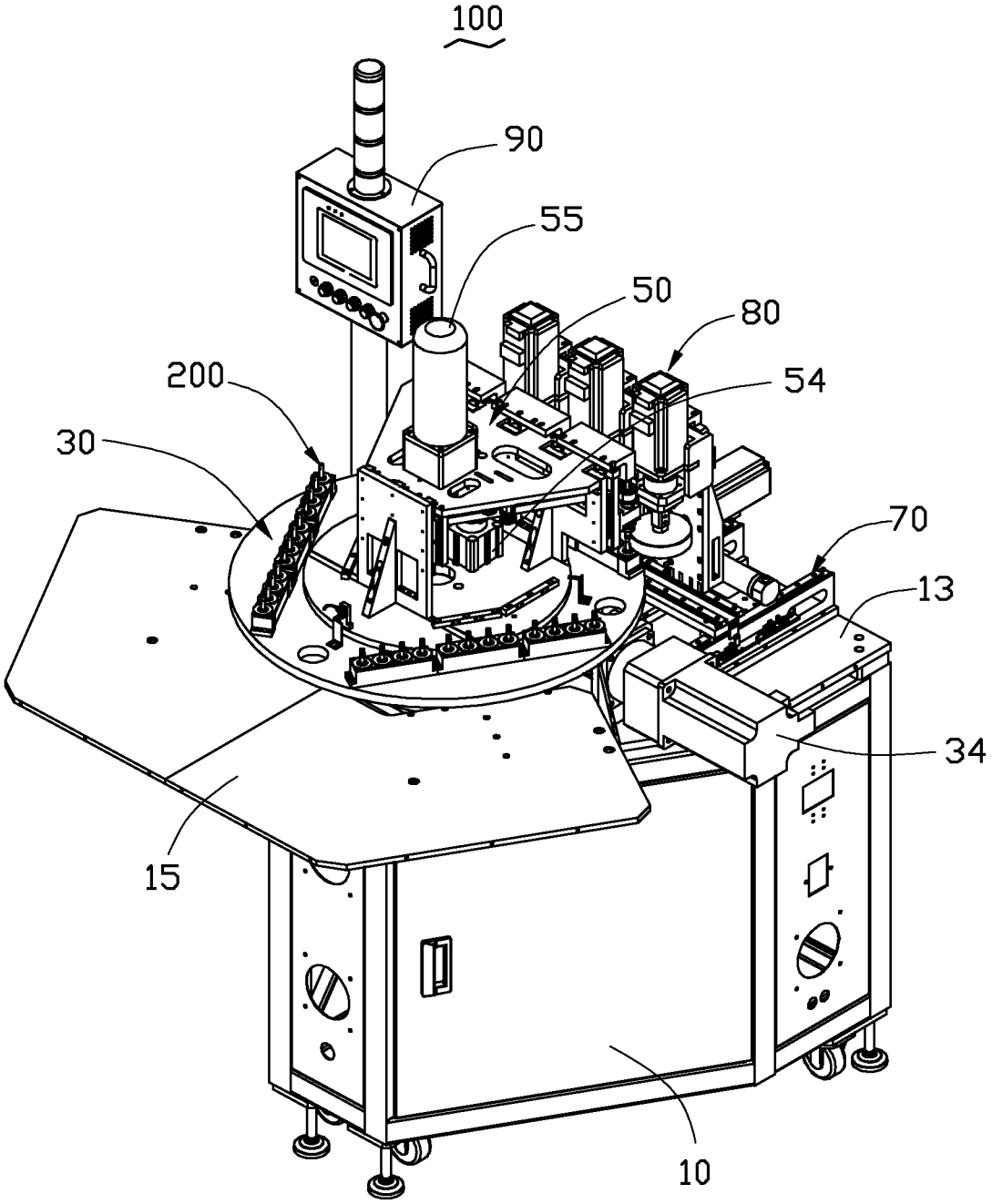
FIG. 1 is an isometric view of a deburring machine including a transport mechanism, a rotating mechanism, four rails and a deburring mechanism.
Figure 2:
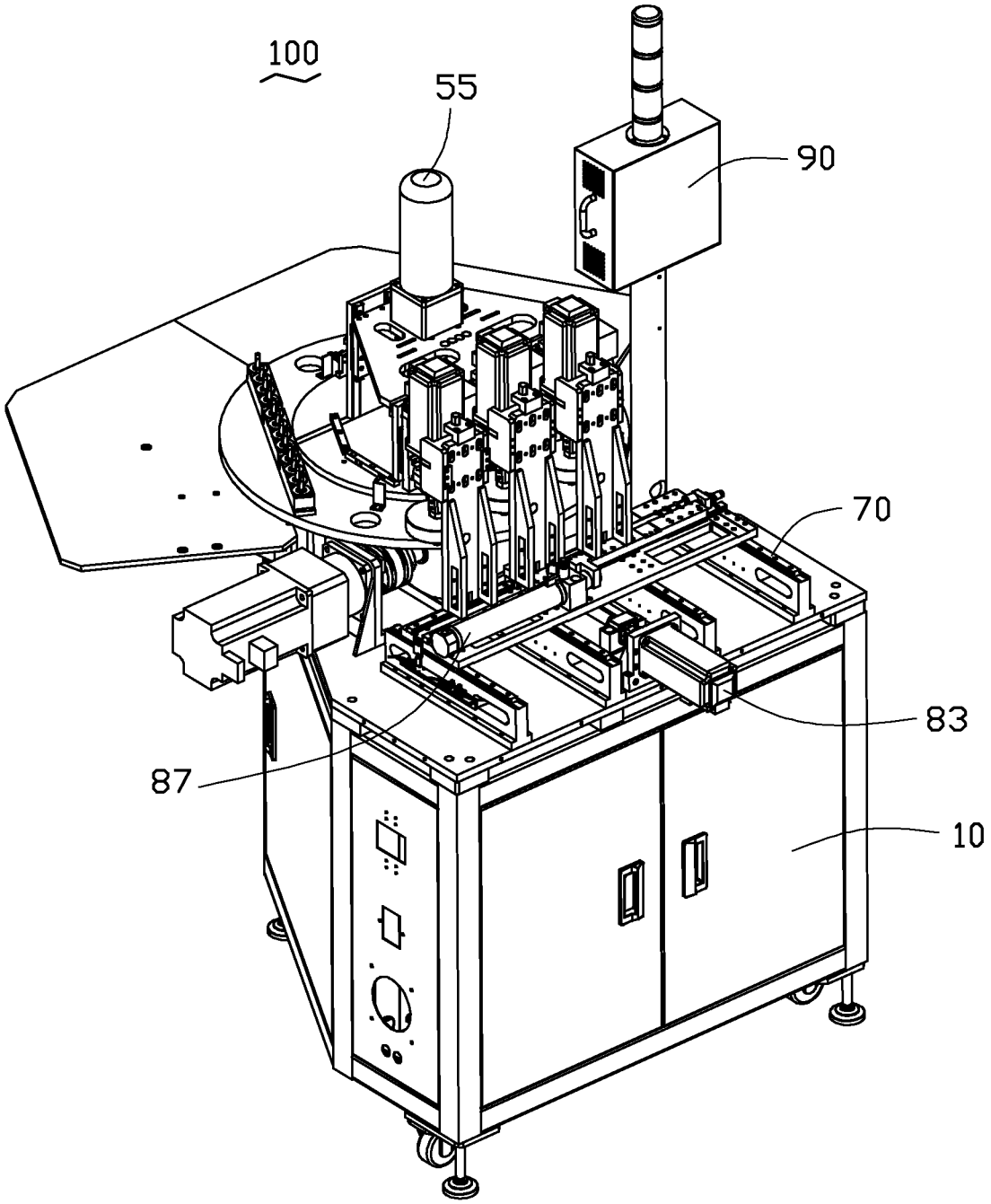
FIG. 2 is similar to FIG. 1, but viewed from another aspect.
Figure 3:
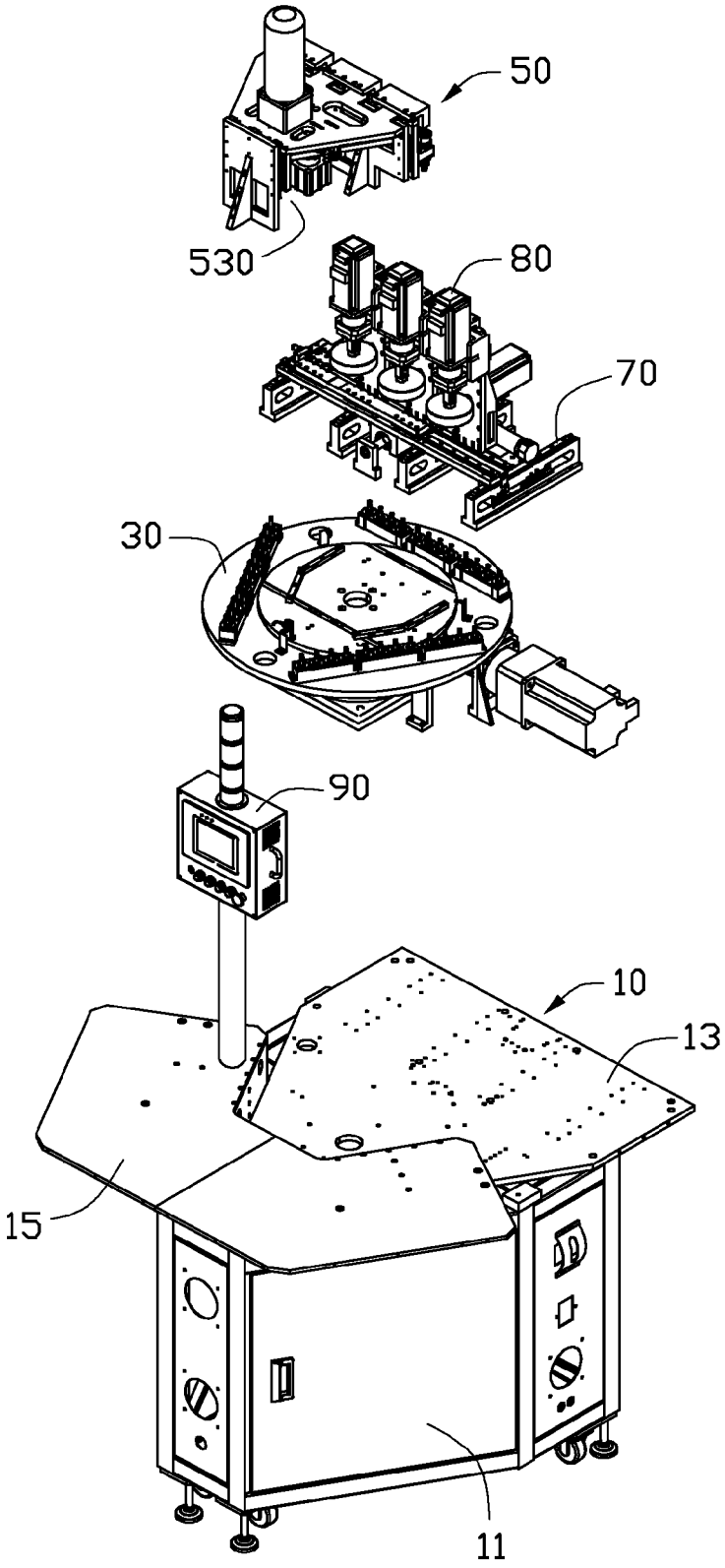
FIG. 3 is an exploded, isometric view of the deburring machine of FIG. 1.
Figure 4:
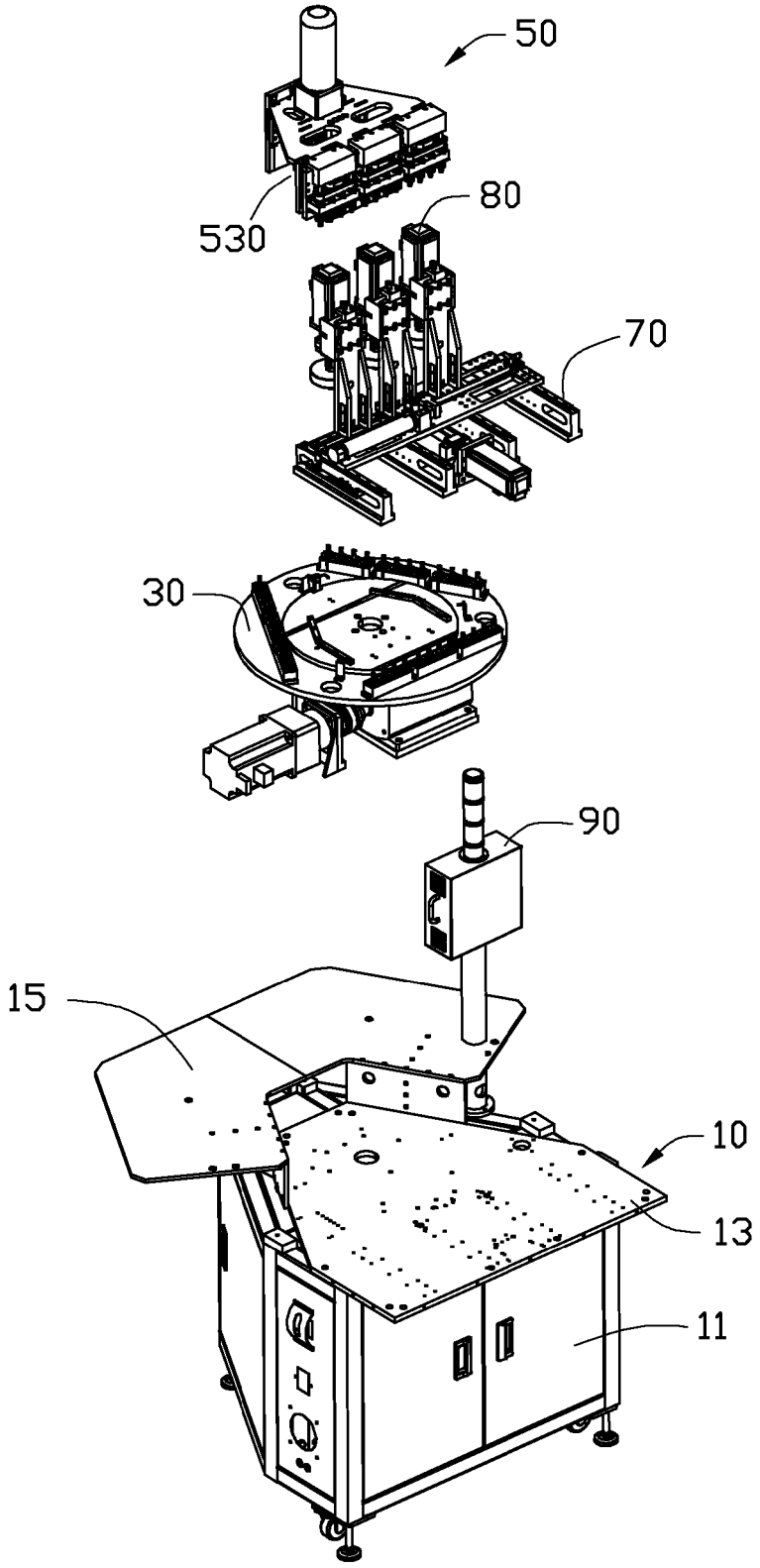
FIG. 4 is similar to FIG. 3, but viewed from another aspect.

FIGS. 1 through 4, show a deburring machine 100 for mechanically removing burrs from a plurality of workpieces 200. In the illustrated embodiment, each workpiece 200 is substantially a cylinder. A groove (not shown) is defined in a peripheral surface of the workpiece 200. The deburring machine 100 includes a framework 10, a transport mechanism 30, a rotating mechanism 50, four guiding rails 70, a deburring mechanism 80, and a controlling device 90. The transport mechanism 30 is rotatably mounted on the framework 10 for supporting and transporting the workpieces 200. The rotating mechanism 50 is movably positioned on the transport mechanism 30 to position the workpieces 200 and drive the workpieces 200 to rotate. The four guiding rails 70 are positioned on the framework 10 adjacent to the transport mechanism 30 and the rotating mechanism 50. The deburring mechanism 80 is movably mounted on the four guiding rails 70. The deburring mechanism 80 removes the burrs from the workpieces 200 that are transported by the transport mechanism 30. The controlling device 90 is mounted on the framework 10 above the transport mechanism 30 and the rotating mechanism 50. The controlling device 90 is electrically connected with the transport mechanism 30, the rotating mechanism 50, and the deburring mechanism 80 to control the operation of the deburring machine 100.

The framework 10 includes a main body 11, a support table 13 and a counter 15. Both the support table 13 and the counter 15 are positioned on the main body 11. The counter 15 is mounted adjacent to one edge of the main body 11 for placement of the workpieces 200.

Figure 5:
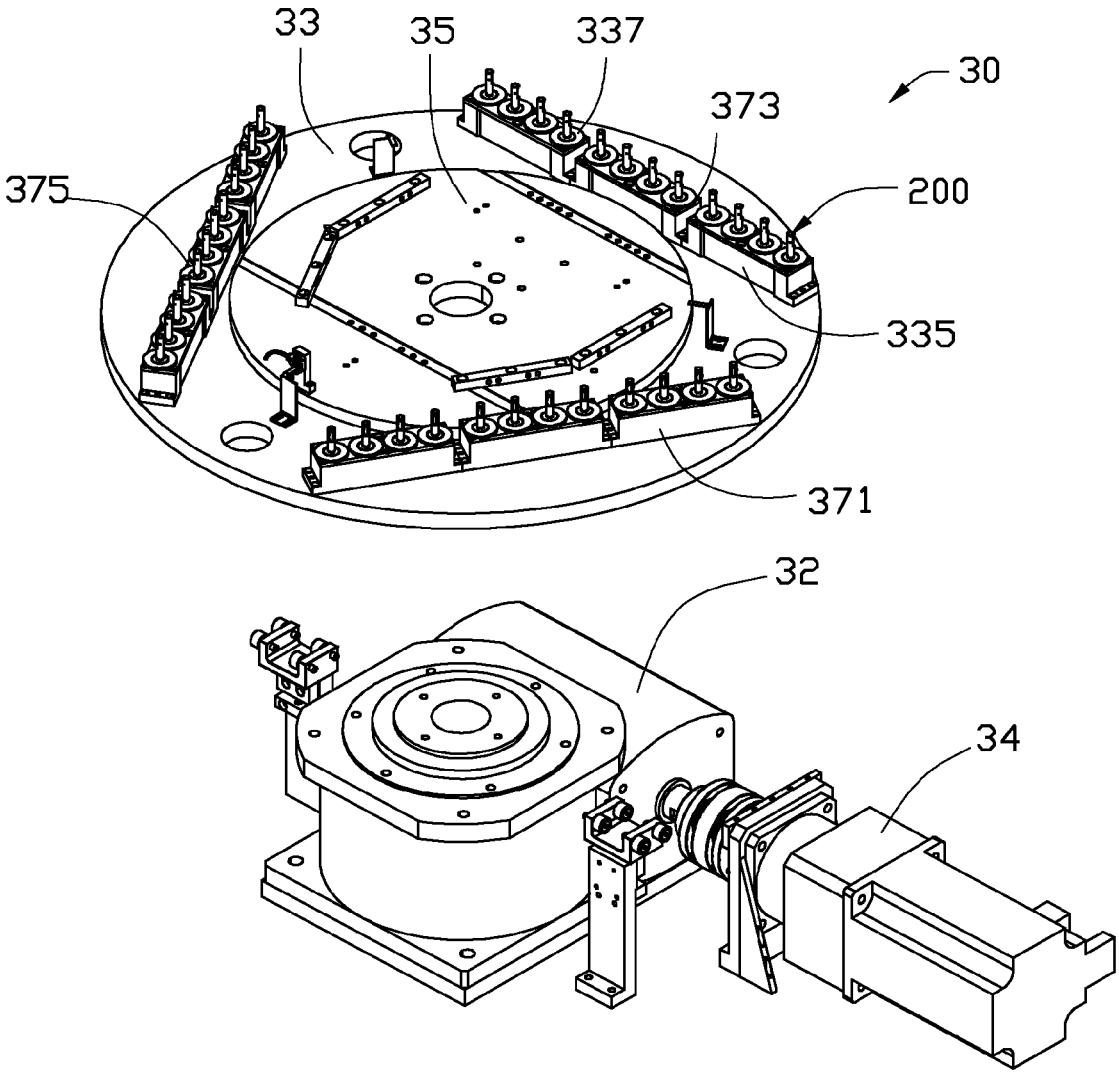
FIG. 5 is an exploded, isometric view of the transport mechanism of the deburring machine of FIG. 1.

Referring also to FIG. 5, the transport mechanism 30 includes a base 32, a multi-station rotating plate 33, a first driver 34 and a loading plate 35. The base 32 is positioned on the support table 13. The multi-station rotating plate 33 is rotatably mounted on the base 32. Nine loading members 335 are positioned on the multi-station rotating plate 33. The loading members 335 are divided into three groups: a first loading member group 371, a second loading member group 373 and a third loading member group 375. The first loading member group 371 uploads the workpieces 200 prior to and requiring deburring treatment. The second loading member group 373 is for holding the workpieces 200 during deburring. The third loading member group 375 unloads the workpieces 200 that have been deburred. The first, third loading member groups 371 and 375 are adjacent to the counter 15; the second loading member group 373 is away from the counter 15. Four first rotating members 337 are separately positioned on each loading member 335 for supporting the workpieces 200. Each workpiece 200 sleeves on each one first rotating member 337. The first driver 34 is mounted on the support table 13 adjacent to the counter 15 and connects to the base 32. The first driver 34 is under the multi-station rotating plate 33. The first driver 34 drives the multi-station rotating plate 33 to rotate relative to the base 32.

The loading plate 35 is fixed to the base 32 above the multi-station rotating plate 33. In the illustrated embodiment, the first driver 34 is a motor; the transport mechanism 30 is a decollator; the number of the loading members 335 and the rotating members 337 are designed and determined according to the practical needs or application.

Figure 6:
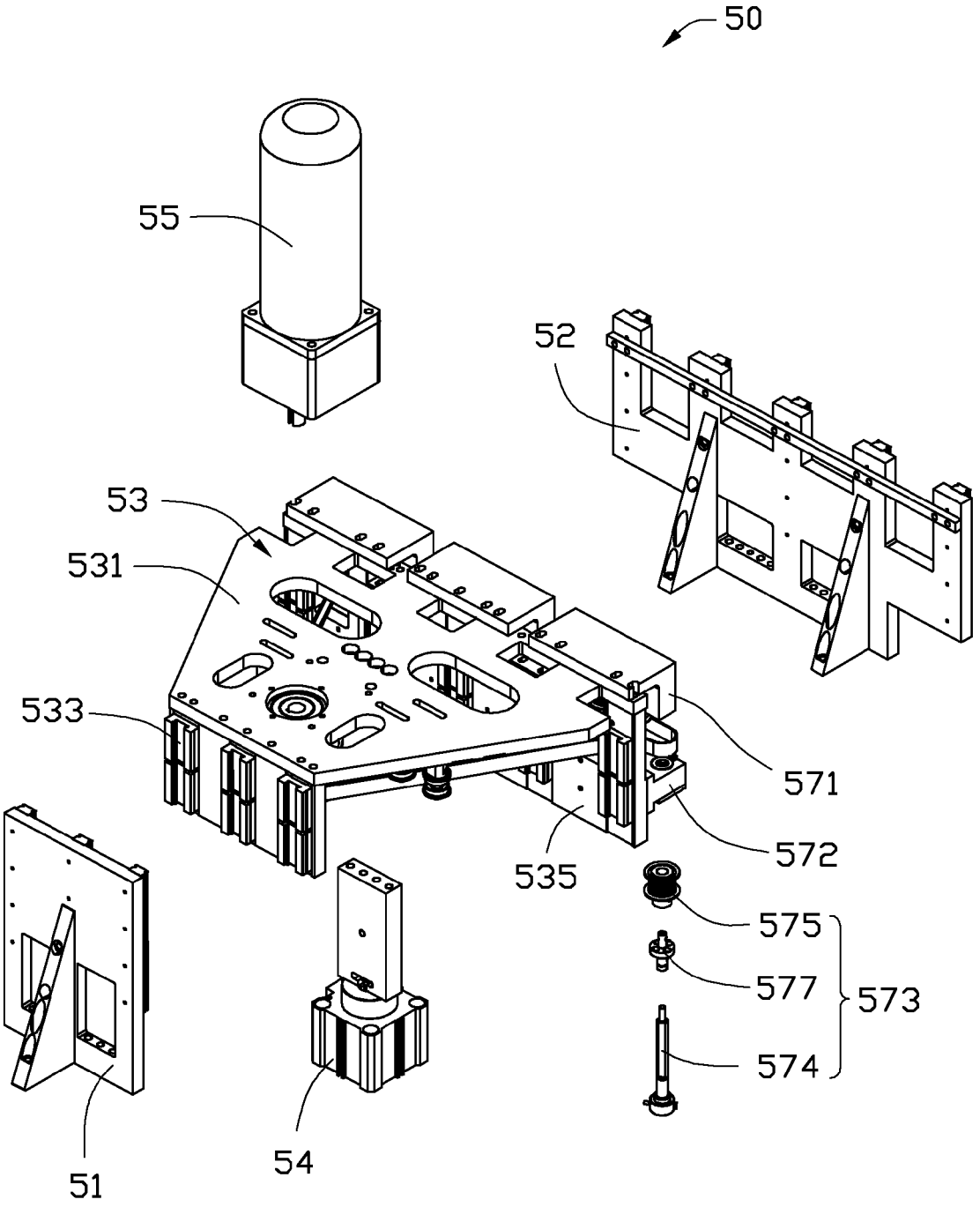
FIG. 6 is an exploded, isometric view of the rotating mechanism of the deburring machine of FIG. 1.
Figure 7:
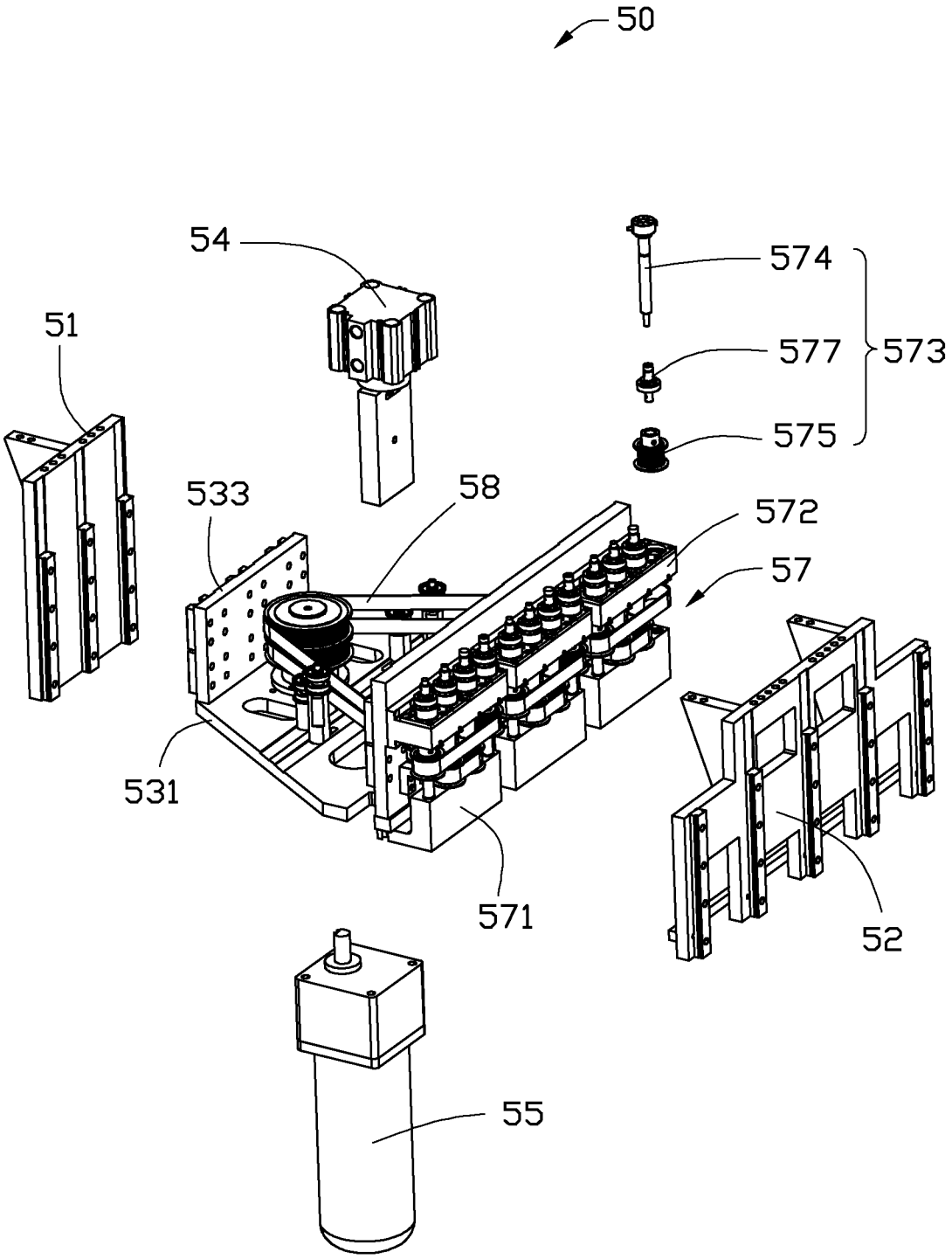
FIG. 7 is similar to the FIG. 6, but viewed from another aspect.

FIGS. 6 and 7, show that the rotating mechanism 50 is movably mounted on the loading plate 35 for driving the workpieces 200 to rotate. The rotating mechanism 50 includes a first mounting member 51, a second mounting member 52, a sliding seat 53, a second driver 54, a third driver 55, three rotating assemblies 57 and a belt 58. The first, second mounting members 51, 52 are slidably assembled with two sides of the sliding seat 53, perpendicularly positioned on the loading plate 35, and are parallel to and spaced from each other. The sliding seat 53 includes a top board 531, a first sliding board 533 and a second sliding board 535. The top board 531 is parallel to the loading plate 35. Opposite ends of the top board 531 are connected with the first sliding board 533 and the second sliding board 535, respectively. The top board 531, the first sliding board 533 and the second sliding board 535 forms a receiving space 530 (show in FIG. 4). The first mounting member 51 is slidably positioned at one side of the first sliding board 533 away from the receiving space 530. The second mounting member 52 is slidably positioned at one side of the second sliding board 535 away from the receiving space 530. The second driver 54 is positioned on the loading plate 35, and connected with the top board 531 for driving the sliding seat 53 to move the first, second mounting members 51, 52 relative to the loading plate 35. The third driver 55 is mounted on the top board 531 and extends inwardly towards the receiving space 530. The third driver 55 connects with the rotating assemblies 57 via the belt 58 for driving the rotating assemblies 57 to rotate. In the illustrated embodiment, the first driver 54 is a cylinder; the third driver 55 is a motor.

The three rotating assemblies 57 are mounted on one side of the second sliding board 535 away from the receiving space 530 and connect with the top board 531 above the second loading member group 373. The rotating assemblies 57 drive the workpieces 200 to rotate. Each rotating assembly 57 includes an installation block 571, a guiding block 572 and a rotating unit 573 positioned between the installation block 571 and the guiding block 572. The installation block 571 is mounted on one end of the top board 531 adjacent to the second sliding board 535. The guiding block 572 is positioned on the second sliding board 535 under the installation block 571. Each rotating unit 573 includes a rotating shaft 574, a roller 575 and a second rotating member 577. The rotating shaft 574 is rotatably connected with the installation block 571, passed through the guiding block 572, and extended out of the guiding block 572. The roller 575 sleeves on the rotating shaft 574 between the installation block 571 and the guiding block 572 for driving the rotating shaft 574 to rotate. The second rotating member 577 is mounted at an end of the rotating shaft 574 away from the installation block 571. The belt 58 runs around the third driver 55, passing through the second mounting member 52 and the second sliding board 535, and runs around the rollers 575. In alternative embodiments, the first, second mounting members 51 and 52 can be deleted, the installation block 571, the guiding block 572, the roller 575 and the second rotating member 577 can also be deleted, and then the rotating shaft 574 is rotatably mounted on the sliding seat 53.

The four guiding rails 70 are positioned parallel on the support table 13 and spaced from each other. The guiding rails 70 extend towards the transport mechanism 30.

Figure 8:
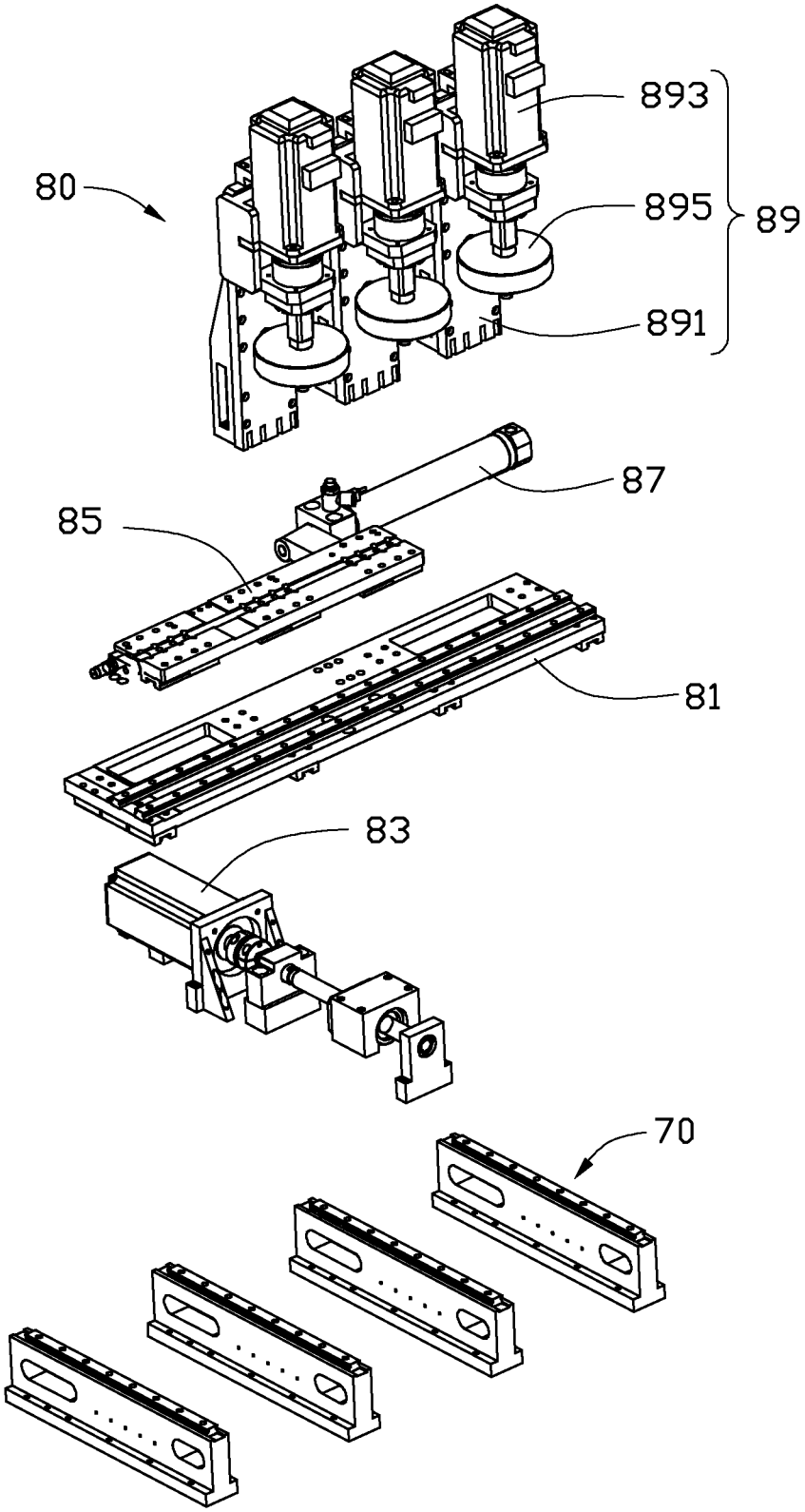
FIG. 8 is an exploded, isometric view of a deburring mechanism and the four rails of the deburring machine of FIG. 2.

FIG. 8 shows the deburring mechanism 80 movably positioned on the guiding rails 70 for removing the burrs of the workpieces 200. The deburring mechanism 80 includes a first pushing member 81, a fourth driver 83, a second pushing member 85, a fifth driver 87 and three deburring units 89. The first pushing member 81 is movably positioned on the guiding rails 70 and extend perpendicular to the four guiding rails 70. The fourth driver 83 is positioned on the support table 13 between two neighboring guiding rails 70. The fourth driver 83 is connected with the first pushing member 81 to drive the first pushing member 81 move along the four guiding rails 70. The second pushing member 85 is movably positioned on the first pushing member 81 adjacent to the transport mechanism 30. The second pushing member 85 extends perpendicularly to the four guiding rails 70. The fifth driver 87 is mounted on the first pushing member 81 away from the transport mechanism 30, and connected to the second pushing member 85 to drive the second pushing member 85 to move perpendicularly to the four guiding rails 70. In the illustrated embodiment, the fourth driver 83 is a motor; the fifth driver 87 is a cylinder.

The three deburring units 89 are positioned parallely on the second pushing member 85 and spaced from each other. Each deburring unit 89 includes a supporting member 891, a sixth driver 893 and a deburring head 895. The supporting member 891 is perpendicularly positioned on the second pushing member 85. The sixth driver 893 is mounted on an end of the supporting member 891 away from the second pushing member 85, and facing the transport mechanism 30 for driving the deburring head 895 to rotate under high speed. The deburring head 895 is rotatably mounted on the sixth driver 893, between the sixth driver 893 and the second pushing member 85. In the illustrated embodiment, the sixth driver 893 is a motor; the deburring head 895 is a polishing wheel.

The controlling device 90 is mounted on the framework 10 above of the transport mechanism 30 and the rotating mechanism 50. The controlling device 90 is electrically connected with the transport mechanism 30, the rotating mechanism 50, and the deburring mechanism 80 so as to control the operation of the deburring machine 100.

In assembly, the transport mechanism 30 is first mounted on the framework 10. The first, second mounting members 51 and 52 are positioned on the loading plate 35. Then the second driver 54 is positioned on the loading disc 35, between the first and second mounting members 51, 52. The rotating assembly 57 is assembled with the sliding seat 53. The sliding seat 53 is movably assembled with the first and second mounting members 51, 52. The second driver 54 is connected with the top board 531. Alter that, the third driver 55 is positioned on the top board 531 and extends inward into the receiving space 530. The four guiding rails 70 are positioned on the support table 13 adjacent to the rotating assembly 57 and away from the counter 15. The fourth driver 83 is positioned on the supporting table 13. The first pushing member 81 is slidably positioned on the four guiding rails 70 and connected with the fourth driver 83. The second pushing member 85 and the fifth driver 87 are mounted on the first pushing member 81, respectively. The three deburring units 89 are assembled with the second pushing member 85. The controlling device 90 is finally positioned above of the framework 10.

When the deburring machine 100 is in use, the workpieces 200 needing or requiring deburring treatment are sleeved on each first rotating member 337 of the first loading member group 371, respectively. The workpieces 200 are transported to the deburring mechanism 80 and placed under the rotating assembly 57 when the muti-station rotating plate 33 rotates anticlockwise or clockwise 120 degrees. The second driver 54 drives the sliding seat 53 to move toward the loading plate 35. Each second rotating member 577 moves down and connects with the workpiece 200 configured under each second rotating member 577. The third driver 55 drives the second rotating members 577 to rotate. Each workpiece 200 connecting with each second rotating member 577 is driven to rotate. The first pushing member 81 is driven to move towards the rotating assembly 57 along the guiding rails 70. The deburring heads 895 are driven to rotate by the sixth driver 893. The deburring heads 895 remove the burrs of the workpieces 200 when the first pushing member 81 reaches the preset position. The second pushing member 85 is driven to reciprocate along the first pushing member 81. The workpieces 200 are transported to the third loading member group 375 when the preset deburring time arrives or reached. At the same time, a new batch of workpieces 200 are transported for receiving the deburring process treatment, and the workpieces 200 that have been debarred are taken down.

The transport mechanism 30 includes multi-stations. Therefore, the uploading, deburring and unloading procedures of workpieces 200 can be done at the same time. The transport mechanism 30 and the rotating mechanism 50 position the workpieces 200 accurately during the deburring process treatment. The workpieces 200 are driven to rotate by the rotating shaft 574; the deburring head 895 is driven to perform a cycling motion along the first pushing member 81. So the deburring head 895 removes the burrs of the workpieces 200 totally and cleanly. The deburring machine 100 mechanically removes massive quantities of burrs from the workpieces 200 because of the cooperation of the transport mechanism 30, the rotating mechanism 50, the deburring mechanism 80 and the control of the controlling device 90.

It is believed that the present embodiments and their advantages will be understood from the foregoing description, and it will be apparent that various changes may be made thereto without departing from the spirit and scope of the disclosure or sacrificing all of its material advantages.

What is claimed is:

1. A deburring machine for removing burrs from one or more workpieces, comprising:

a framework;

a deburring mechanism mounted on the framework, comprising:

a plurality of deburring units positioned on the framework;and a transport mechanism positioned on the framework adjacent to the plurality of deburring units, comprising:

a base positioned on the framework;

a multi-station rotating plate rotatably positioned on the base;

a loading plate positioned on the base above of the multi-station rotating plate;

a first driver positioned on the framework and connected to the base; and a rotating mechanism movably positioned on the loading plate, the rotating mechanism configured to rotate the one or more workpieces, wherein the first driver is configured for driving the multi-station rotating plate to transport the workpieces to the plurality of deburring units, and the plurality of deburring units are configured for removing the burrs from the one or more workpieces.

2. The deburring machine of claim 1, wherein a plurality of loading members are positioned on the multi-station rotating plate around the loading plate, a plurality of first rotating members are separately positioned on each loading member, and each workpiece sleeves on one first rotating member.

3. The deburring machine of claim 1, wherein the rotating mechanism comprises a sliding seat and a second driver, the second driver is positioned on the loading plate and connects with the sliding seat for driving the sliding seat to perpendicularly move relative to the loading plate.

4. The deburring machine of claim 3, wherein the rotating mechanism further comprises a first mounting member and a second mounting member, the first mounting member and the second mounting member are parallelly position on the loading plate and spaced from each other, and the first mounting member and the second mounting member are slidably assembled with two sides of the sliding seat.

5. The deburring machine of claim 4, wherein the sliding seat comprises a top board, a first sliding board,. and a second sliding board, the top board is parallel to the loading plate, opposite ends of the top board are connected with the first sliding board and the second sliding board, respectively; the top board, the first sliding board and the second sliding board form a receiving space; the second driver is received in the receiving space.

6. The deburring machine of claim 5, wherein the first mounting member is slidably positioned at one side of the first sliding board away from the receiving space; the second mounting member is slidably positioned at one side of the second sliding board away from the receiving space.

7. The deburring machine of claim 3, wherein the rotating mechanism further comprises a plurality of rotating assemblies and a third driver, each rotating assembly comprises a plurality of rotating units, each rotating unit comprises a rotating shaft, the third driver is positioned on the sliding seat and connected with each rotating shaft, one distal end of each rotating shaft is movably assembled with the sliding seat adjacent to a plurality of deburring assemblies, and another distal end of each rotating shaft connects with a corresponding workpiece, the third driver drives each rotating shaft to rotate.

8. The deburring machine of claim 7, wherein each rotating unit further comprises a second rotating member, connecting with one rotating shaft adjacent to the multi-station rotating plate, each second rotating member connects with one workpiece for driving a respective workpiece to rotate.

9. The deburring machine of claim 1, wherein the deburring machine further comprises at least one guiding rail, the at least one guiding rail is positioned on the framework and extends towards the transport mechanism, the plurality of deburring units are movably positioned on the at least one guiding rail relative to the frame work.

10. The deburring machine of claim 9, wherein the deburring mechanism further comprises a first pushing member, the first pushing member is movably positioned on the at least one guiding rail and extends perpendicular to the at least one guiding rail, the plurality of deburring units are rotatably positioned on the first pushing member.

11. The deburring machine of claim 10, wherein the deburring mechanism further comprises a fourth driver, the fourth driver is positioned on the framework and connects with the first pushing member, the fourth driver is configured to drive the first pushing member to move along the at least one guiding rail.

12. The deburring machine of claim 10, wherein the deburring mechanism further comprises a second pushing member, the second pushing member is movably positioned on the first pushing member and extends perpendicular to the at least one guiding rail, the plurality of deburring units are rotatably positioned on the second pushing member.

13. The deburring machine of claim 12 wherein the deburring mechanism further comprises a fifth driver, the fifth driver is positioned on the first pushing member and connects with the second pushing member, the fourth driver is configured to drive the second pushing member to move along the first pushing member.

14. The deburring machine of claim 1, wherein each deburring unit comprises a supporting member and a deburring head, each supporting member is positioned on the framework, each deburring head is rotatably mounted on a respective supporting member for removing the burrs of the workpieces transported by the transport mechanism.

15. The deburring machine of claim 14, wherein each deburring unit further comprises a sixth driver mounted on a respective supporting member and connected with a respective deburring head for driving the respective deburring head to rotate.

16. The deburring machine of claim 1, wherein the deburring machine further comprises a controlling device positioned on the framework above of the transport mechanism; the control device is electrically connected with the transport mechanism and the deburring mechanism for controlling an operation of the deburring machine.

17. The deburring machine of claim 1, wherein the framework comprises a main body, a support table and a counter; both the support table and the counter are positioned on the main body, the plurality of deburring units, the base and the first driver are separately positioned on the support table; the counter is mounted on an edge of the main body away from the deburring mechanism for placing workpieces.

18. A deburring machine, comprising:

a framework comprising a main body, a support table, and a counter, the support table and the counter positioned on the main body;

a deburring mechanism mounted on the support table, comprising:

a plurality of deburring units positioned on the support table; and a transport mechanism positioned on the support table adjacent to the plurality of deburring units, comprising:

a base positioned on the support table;

a multi-station rotating plate rotatably positioned on the base; and a driver configured for driving the multi-station rotating plate to transport workpieces to the plurality of deburring units.

19. A deburring machine, comprising:

a framework;

a deburring mechanism mounted on the framework, comprising:

a plurality of deburring units positioned on the framework; and a transport mechanism positioned on the framework adjacent to the plurality of deburring units, comprising:

a base positioned on the framework;

a multi-station rotating plate rotatably positioned on the base; and a driver configured for rotating the multi-station rotating plate;

a guiding rail positioned on the framework and extending towards the transport mechanism; and a push member movably positioned on the guiding rail and extending perpendicular to the guiding rail, wherein the plurality of deburring units are rotatably positioned on the push member.

* * * * *